US008112025B2

(12) United States Patent
Goretzky et al.

(10) Patent No.: US 8,112,025 B2
(45) Date of Patent: Feb. 7, 2012

(54) COOLING DEVICE AND COOLING METHOD FOR A PRINTING SUBSTRATE IN AN ELECTROGRAPHIC PRINTER OR COPIER

(75) Inventors: Michael Goretzky, Eching (DE); Stefan Mayr, Gurnoebach (DE)

(73) Assignee: Oce Printing Systems GmbH, Poing (DE)

( * ) Notice: Subject to any disclaimer, the term of this patent is extended or adjusted under 35 U.S.C. 154(b) by 709 days.

(21) Appl. No.: 12/245,854

(22) Filed: Oct. 6, 2008

(65) Prior Publication Data

US 2009/0092427 A1 Apr. 9, 2009

(30) Foreign Application Priority Data

Oct. 8, 2007 (DE) ..... 10 2007 048 158

(51) Int. Cl.
*G03G 15/20* (2006.01)
*G03G 21/20* (2006.01)

(52) U.S. Cl. ..... 399/341; 399/92; 399/406

(58) Field of Classification Search ..... 399/341, 399/406, 92
See application file for complete search history.

(56) References Cited

U.S. PATENT DOCUMENTS

| | | | | |
|---|---|---|---|---|
| 4,959,693 | A | 9/1990 | Mitsuya et al. | 399/322 |
| 5,086,209 | A * | 2/1992 | Kintz et al. | 399/92 X |
| 5,557,388 | A | 9/1996 | Creutzmann et al. | 399/92 |
| 6,226,474 | B1 * | 5/2001 | Kowalski et al. | 399/92 |
| 6,246,856 | B1 | 6/2001 | Kopp et al. | 399/299 |
| 6,567,629 | B2 | 5/2003 | Anderson et al. | 399/92 |
| 6,907,220 | B2 | 6/2005 | Mitsuya et al. | 399/328 |
| 7,489,895 | B2 * | 2/2009 | Tani | 399/406 X |
| 2002/0191993 | A1 * | 12/2002 | Bartscher et al. | 399/320 |
| 2004/0234308 | A1 * | 11/2004 | Behnke et al. | 399/341 |
| 2007/0059023 | A1 * | 3/2007 | Koshida | 399/92 |
| 2007/0059024 | A1 * | 3/2007 | Kitayama | 399/92 |
| 2008/0181688 | A1 * | 7/2008 | Kurita | 399/341 |
| 2009/0103959 | A1 * | 4/2009 | Koyama et al. | 399/341 |

FOREIGN PATENT DOCUMENTS

| | | |
|---|---|---|
| DE | 38 38 021 | 6/1989 |
| DE | 42 35 667 | 1/1994 |
| DE | 201 19 854 | 4/2002 |
| EP | 0 758 766 | 2/1997 |
| WO | WO 94/09409 | 4/1994 |
| WO | WO 98/39691 | 9/1998 |

* cited by examiner

*Primary Examiner* — Sophia S Chen
(74) *Attorney, Agent, or Firm* — Schiff Hardin LLP

(57) ABSTRACT

In a cooling device for a printing substrate after passage through a fixing station, a transport path is provided for the printing substrate. A first cooling unit is provided along one side of the transport path. The first cooling unit has a first perforated plate facing towards the printing substrate, a coolant being conducted through the perforated plate. A second cooling unit is provided along an opposite side of the transport path. This second cooling unit has a perforated plate on a surface facing towards the printing substrate. A coolant is conducted through the perforated plate onto the opposite side of the printing substrate. A nip unit for the printing substrate has a nip roll integrated into the second cooling unit such that the nip roll is cooled by the second cooling unit.

16 Claims, 4 Drawing Sheets

COOLING DEVICE AND COOLING METHOD FOR A PRINTING SUBSTRATE IN AN ELECTROGRAPHIC PRINTER OR COPIER

BACKGROUND

The preferred embodiment concerns a cooling device and a cooling method for a printing substrate in an electrographic printer or copier.

Workflow printer or copiers are known (see for example WO 98/39691 A1). In such a printer or copier, charge images of the images to be printed are generated on a charge image carrier (for example a photoconductor belt). The charge image carrier is subsequently moved past developer stations, respectively once per color. For example, these transport developer comprised of toner and carrier to the charge image carrier. The toner migrates onto the charge image carrier corresponding to the charge images and inks these. The toner images are transfer-printed onto a printing substrate in the next step and are fixed on this. The precise workflow of the printing method can be learned from WO 98/39691 A1, the content of which is herewith incorporated into the disclosure.

A thermofixing is normally used to fix toner images onto the printing substrate. For example, fixing rollers (of which at least one is heated) are used for this, or infrared radiators are used as a heat source. The thermofixing of the toner images on the printing substrate requires that the printing substrate still exhibit a temperature of, for example, 120° C. or higher upon leaving the fixing station, such that a further processing of the printing substrate is difficult. In order to remedy this disadvantage, it is known to cool the printing substrate after the fixing station.

According to DE 42 35 667 C1, cooled air is blown onto the printing substrate to cool the printing substrate. The cooling device used for this possesses cooling surfaces provided with openings. Cold air is supplied to the openings via an air guide channel, flows out from the openings below the printing substrate and there forms a cooling air cushion. Air is simultaneously blown onto the other side of the printing substrate, and in fact counter to the travel direction of the printing substrate.

Additional cooling devices are known from, for example: DE 38 38 021 C2; EP 0 758 766 B1; DE 201 19 854 U1; U.S. Pat. Nos. 6,907,220 B2; 6,567,629 B2. For example, there aerators are used to cool a printing substrate, or externally or internally cooled rollers.

SUMMARY

It is an object to specify a cooling device for a printing substrate that is arranged at the output of a fixing station, is thereby executed in a compact manner and in spite of this sufficiently cools the printing substrate at high speed of the printing substrate.

In a cooling device for a printing substrate after passage through a fixing station, a transport path is provided for the printing substrate. A first cooling unit is provided along one side of the transport path. The first cooling unit has a first perforated plate facing towards the printing substrate, a coolant being conducted through the perforated plate. A second cooling unit is provided along an opposite side of the transport path. This second cooling unit has a perforated plate on a surface facing towards the printing substrate. A coolant is conducted through the perforated plate onto the opposite side of the printing substrate. A nip unit for the printing substrate has a nip roll integrated into the second cooling unit such that the nip roll is cooled by the second cooling unit.

An exemplary embodiment is presented in drawing figures hereafter.

DESCRIPTION OF THE PREFERRED EMBODIMENT

Figure 1:
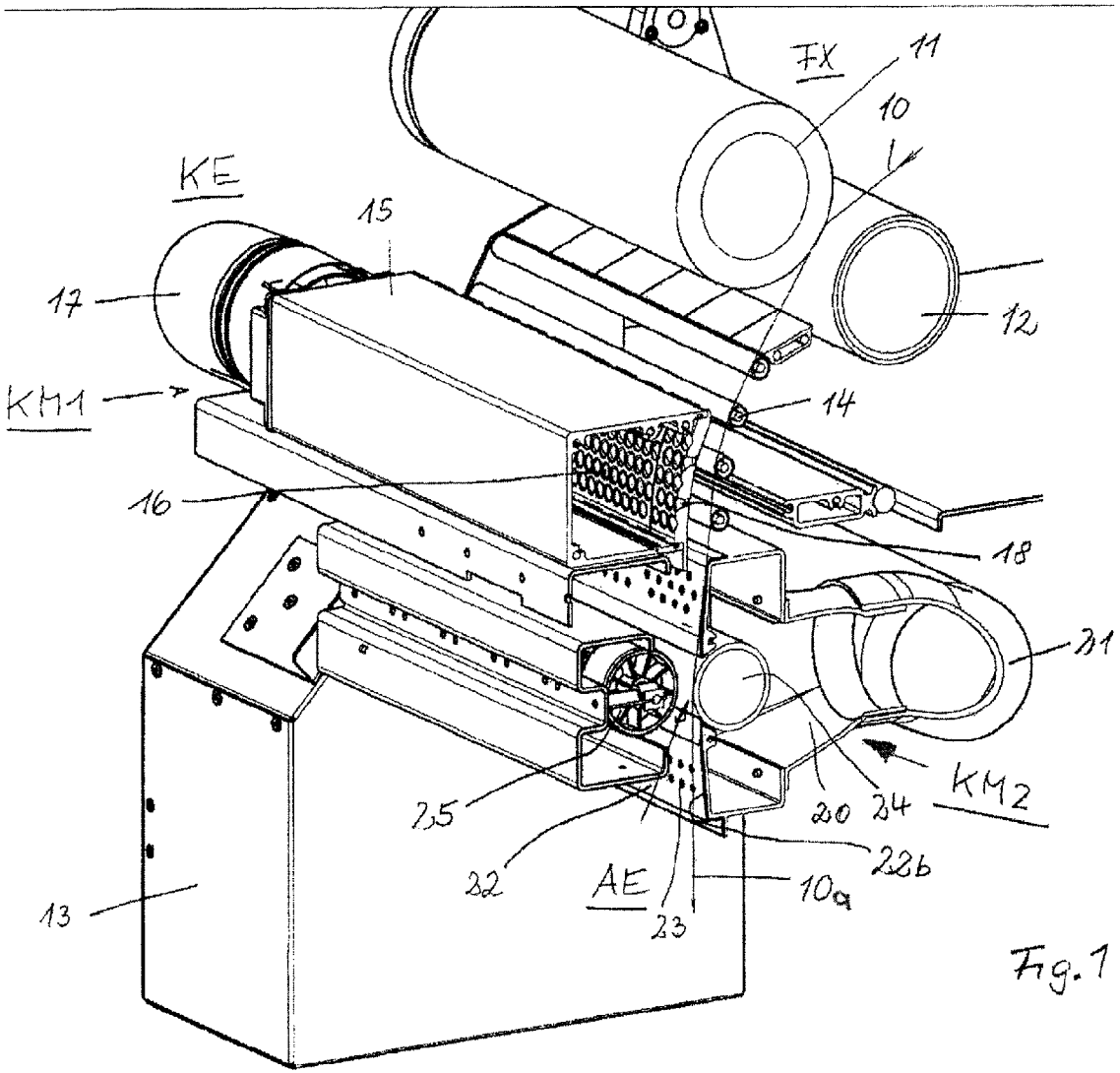
FIG. 1 is a perspective view of the cooling device.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention related are included.

The cooling device for a printing substrate is arranged at the output of the fixing station. It additionally cools a nip roll.

The cooling device has a transport path for the printing substrate. A first cooling unit connected with a first coolant medium source is provided along one side of the transport path for the printing substrate. This cooling unit has a first perforated plate on the surface facing towards the printing substrate, through which perforated plate a coolant can be conducted onto the one side of the printing substrate. A second cooling unit connected with a second coolant source is provided along the other, opposite side of the transport path for the printing substrate, which unit has a second perforated plate on the surface facing towards the printing substrate, through which perforated plate a coolant can be conducted onto the other side of the printing substrate. A nip unit for the printing substrate that has a nip roll is integrated into the second cooling unit, such that the nip unit is cooled by the first and/or second cooling unit.

Such a realization of the cooling device enables a compact design with a short cooling path that on the one hand is sufficient to cool the printing substrate even at high print speed so that the printing substrate can be processed further, and on the other hand the nip roll is also cooled. If the printing substrate is placed on the nip roll, it is additionally, advantageously cooled by this.

For a compact design it is advantageous if the first and second coolant sources are combined into a common coolant source. Furthermore, it is advantageous when the second cooling unit is arranged adjacent and next to the coolant source and the first cooling unit is arranged above the coolant source, since then the feed of the coolant can be implemented via short cooling tubes, for example.

Cooled air can appropriately be provided as a coolant, and a cooled air source in which, for example, a ventilator is arranged to move the cooled air, can be used as a coolant source.

In order to be able to access the individual structural units of the cooling device, and in order to be able to exchange the printing substrate in a simple manner, it is advantageous that the second cooling unit is executed such that it, together with the nip roll, can pivot away from the first cooling unit.

In particular, nozzle plates can be provided as perforated plates.

Cooling channels arranged parallel to the printing substrate can be used as a cooling unit, past which cooling channels the printing substrate is directed and which are connected via cooling tubes with the cooled air source. In order to comprehensively cool the printing substrate,

- the first cooling channel can have a nozzle plate on the one side facing the printing substrate, the nozzles of which nozzle plate are shaped such that the cooled air is accelerated towards the printing substrate;
- the second cooling channel can have a perforated plate on the side facing the printing substrate, via the cooling holes of which perforated plate the cooled image archive is directed onto the printing substrate.

The cooling effect is additionally increased when the nip roll is also cooled. This can then absorb heat from the printing substrate and, for example, conduct it to the second cooling channel. This can be realized such that the nip roll is integrated into the second cooling channel. For this, the perforated plate can have a recess into which the nip roll is inserted such that only the surface facing towards the nip roll used to drive the printing substrate projects out from the second cooling channel. This embodiment has the advantage that the nip roll is part of the cooling device and is thereby used not only to transport the printing substrate but also for its cooling. Via this technique, the perforated plate is additionally sub-divided into two perforated plate sections, with the advantage that the printing substrate is cooled both before and after passing by the nip roll. The perforated plate sections thereby blow cooled air under the printing substrate (via the cooling holes) and generate an air cushion on which the printing substrate glides.

A roller saddle can be provided to guide the printing substrate past the nozzle plate of the first cooling channel. It is then appropriate to design the nozzle plate of the first cooling channel so that nozzle plate and roller plate run parallel to one another and form a transport path in which the printing substrate is taught, rests on the roller saddle and is directed through the roller saddle. In this way, a distance from nozzle plate to printing substrate can be set that is optimal for the cooling of the printing substrate.

In order to avoid unwanted heat bands on the printing substrate, the nozzles of the nozzle plate of the first cooling channel can be arranged offset relative to one another. This also applies for the cooling holes of the perforated plate, wherein the cooling holes of the two perforated plate sections can also lie offset relative to one another.

In order to simply design the pivoting of the second cooling channel with nip roll, the second cooling tube can be connected to the cooled air source via a coupling such that the connection of the second cooling tube with the cooled air source detaches upon pivoting away and the connection is reestablished upon pivoting towards.

In summary, the cooling device according to the preferred embodiment has the following advantages:

- The nozzle plate of the first cooling channel has air nozzles that accelerate the cooled air towards the printing substrate.
- The cooling path is optimized so that the nip roll is integrated into the second cooling channel.
- The nip roll is surrounded on all sides by the second cooling channel except for the contact surface facing towards the printing substrate. The nip roll can thus discharge the heat absorbed from the printing substrate to the second cooling channel; it serves as a cooling rib.
- The two cooling channels can be supplied via one cooled air source.
- The second cooling channel, together with the nip roll, can be folded down relative to the first cooling channel and the cooled air source. The access to the structural units of the cooling device is therefore simplified. In order to thereby make the handling easier, the second cooling tube can be connected with the cooled air source via a coupling.
- The nozzles and the cooling holes are arranged offset relative to one another to avoid heat bands on the printing substrate.

FIG. 1 shows a device KE for cooling a printing substrate 10, for example a paper web or a paper sheet, that is arranged at the output of a fixing station FX. Such a cooling device KE is, for example, provided at the output of a printing module; with regard to the design of a corresponding electrographic printing apparatus, refer to WO 98/39691 A1, which is herewith incorporated by reference into the disclosure of the present application. The cooling device KE has the object of cooling the printing substrate 10 at the output of the fixing station FX corresponding to the DE 42 35 667 C1; DE 42 35 667 C1 is herewith likewise incorporated by reference into the disclosure.

The fixing station FX according to FIG. 1 has a fixing roller 11 and a contact pressure roller 12. Toner images applied on the printing substrate 10 are fixed in a known manner according to the thermofixing method, meaning that the printing substrate 10 runs between the heated fixing roller 11 and contact pressure roller 12, the contact pressure roller 12 presses the printing substrate 10 against the fixing roller 11 for fixing, and the toner images are fixed in the printing substrate 10 via heat and pressure.

When the printing substrate 10 leaves the fixing station FX, this printing substrate 10 still has a temperature of approximately 120° C. or more. A printing substrate 10 with such a temperature is not suitable for the post-processing devices. It is therefore known to cool the printing substrate 10 after the fixing station FX, for example via a device according to DE 42 35 667 C1. A cooling device KE that sufficiently cools the printing substrate 10 even at high speeds is now specified by the preferred embodiment.

The cooling device KE is arranged at the output of the fixing station FX according to FIG. 1. It has the following units:

- on the one side or surface of the printing substrate 10 (for example the printed front side of a printing substrate web), a first cooling unit KM1 for cooling this side;
- on the other side of the printing substrate 10 (for example the back side of a printing substrate web), a second cooling unit KM2 for cooling this other side;
- a source 13 for a coolant (for example cooled air) that is connected with both cooling unit KM1, KM2;
- additionally, a roller saddle 14 that is arranged at the output of the fixing station FX and that directs the printing substrate 10 past the first cooling means KM1;
- a nip unit AE for the printing substrate 10 at the output of the cooling device KE, which nip unit AE draws the printing substrate 10 past the cooling units KM1, KM2.

The first cooling unit KM1 has a first cooling channel 15 that provides a nozzle plate 16 facing towards the printing substrate 10, via which nozzle plate 16 the coolant (cooled air in the following) is blown towards the printing substrate 10. The first cooling channel 15 is connected with the coolant source (in the following a cooled air source 13) via a first cooling hose 17, for example. The nozzle plate 16 has nozzles 18 arranged offset relative to one another. These nozzles 18 are shaped so that the cooled air is accelerated towards the printing substrate 10 in the first cooling channel 15. The nozzle plate 16 is shaped corresponding to the roller saddle 14; for example, if the roller saddle 14 is executed curved a corresponding to FIG. 1, the nozzle plate 16 is executed with corresponding curve so that a transport gap 19 (FIG. 2) of the same distance as the transport path for the printing substrate 10 arises between nozzle plate 16 and roller saddle 14. The first cooling channel 15 is, for example, essentially executed square; however, it can also exhibit a different cross-section. The transport path can, at least in sections, have a distinctly larger width than the thickness of the printing substrate 10.

The printing substrate 10 is transported through the transport gap 19 in the direction 10*a*. The cooling units KM1 and KM2 are arranged on opposite sides along the transport gap 19.

The second cooling unit KM2 is realized as a second cooling channel 20 that is connected with the cooled air source 13 via a second cooling tube 21, for example. The second cooling channel 15 has a perforated plate 22 with cooling holes 23 facing towards the printing substrate 10, via which cooling holes the cooled air is blown towards the other side (for example back side) of the printing substrate 10. The perforated plate 22 is shaped such that an air cushion on which the printing substrate 10 can glide can form between printing substrate 10 and perforated plate 22.

The nip unit AE has a nip roll 24 and a contact pressure roller 25. The contact pressure roller 25 draws the printing substrate 10 through the cooling device KE. In order to be able to cool the nip roll 24, this is integrated into the second cooling channel 20 such that the second cooling channel 20 surrounds the nip roll 24 except for the contact surface 26 used to transport the printing substrate 10. The perforated plate 22 is thereby sub-divided into two perforated plate regions 22*a*, 22*b* between which the nip roll 24 is arranged, such that the nip roll 24 projects beyond the perforated plate 22 and therefore can engage the printing substrate 10. The contact pressure roller 24 can be constructed from individual wheels 27, for example.

The cooled air source 13 is arranged adjacent and next to the second cooling channel 20, such that the connection between cooled air source 13 and second cooling channel 20 via the second cooling tube 21 is short. In contrast to this, the first cooling channel 15 is arranged above the cooled air source 13. The two cooling unit KM1, KM2 and the nip unit AE are thus arranged relative to one another so that the entire cooling device KE achieves an optimal cooling with a minimal space requirement and short cooling path.

To cool the printing substrate 10, this is initially directed past the first cooling channel 15 via the roller saddle 14 such that the one side of the printing substrate 10 is cooled. The printing substrate 10 is subsequently drawn by the nip unit AE past the second cooling channel 20, and the other side (for example back side) of the printing substrate 10 is thereby cooled.

Figure 2:
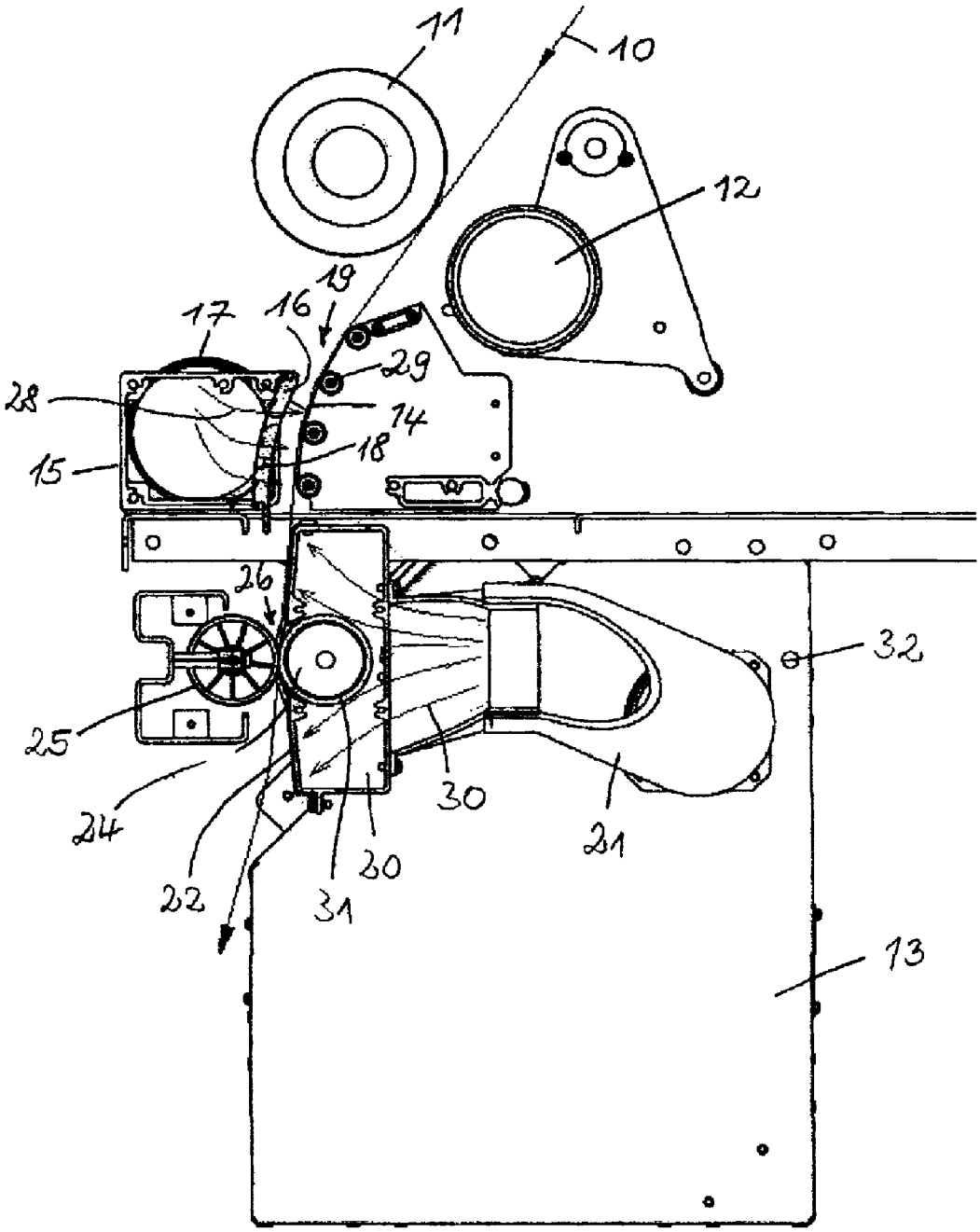
FIG. 2 is a side view of the cooling device.

FIG. 2 shows the cooling device KE from the side. The contact pressure roller 12 is thereby shown folded down from the fixing roller 11. The first cooling channel 15 is arranged opposite the roller saddle 14; and cooled air is blown onto the printing substrate 10 via the nozzles 18 of the nozzle plate 16. The nozzles 18 are shaped according to FIG. 2 such that the cooled air is accelerated towards the printing substrate 10; for example, the nozzles 18 taper towards the printing substrate 10. The cooled air is symbolically represented by lines 28 in FIG. 2. The roller saddle 14 is arranged opposite the nozzle plate 16, which roller saddle 14 is, for example, formed by guide roller 29 situated next to one another as seen in the movement direction of the printing substrate 10.

The second cooling channel 20 is supplied with cooled air (lines 30 in FIG. 2) via the cooling tube 21. To accommodate the nip roll 24, the second cooling channel 20 has a recess 31. The second cooling channel 20 thus completely surrounds the nip roll 24 except for the contact surface 26, with the result that the nip roll 24 is cooled by the cooled air 30. The nip roll 24 extracts heat energy from the printing substrate 10 via heat conduction, which heat energy it passes to the second cooling channel 20. Since the nip roll 24 continuously rotates in the second cooling channel 20, it is continuously washed by cooled air and can thereby dissipate the heat absorbed from the printing substrate 10 very well. The printing substrate 10 is thus optimally cooled on its other side by the perforated plate sections 22*a*, 22*b* and the nip roll 24.

Furthermore, the cooled air source 13 is recognizable from FIG. 2; it has a pivot axle 32 on which the second cooling channel 20 and the nip roll 14 can be pivoted downward. Furthermore, from FIG. 2 it can be learned that the second cooling channel 20 is arranged next to the cooled air source 13 and is connected with the cooled air source 13 on a short path via the second cooling tube 21.

Figure 3:
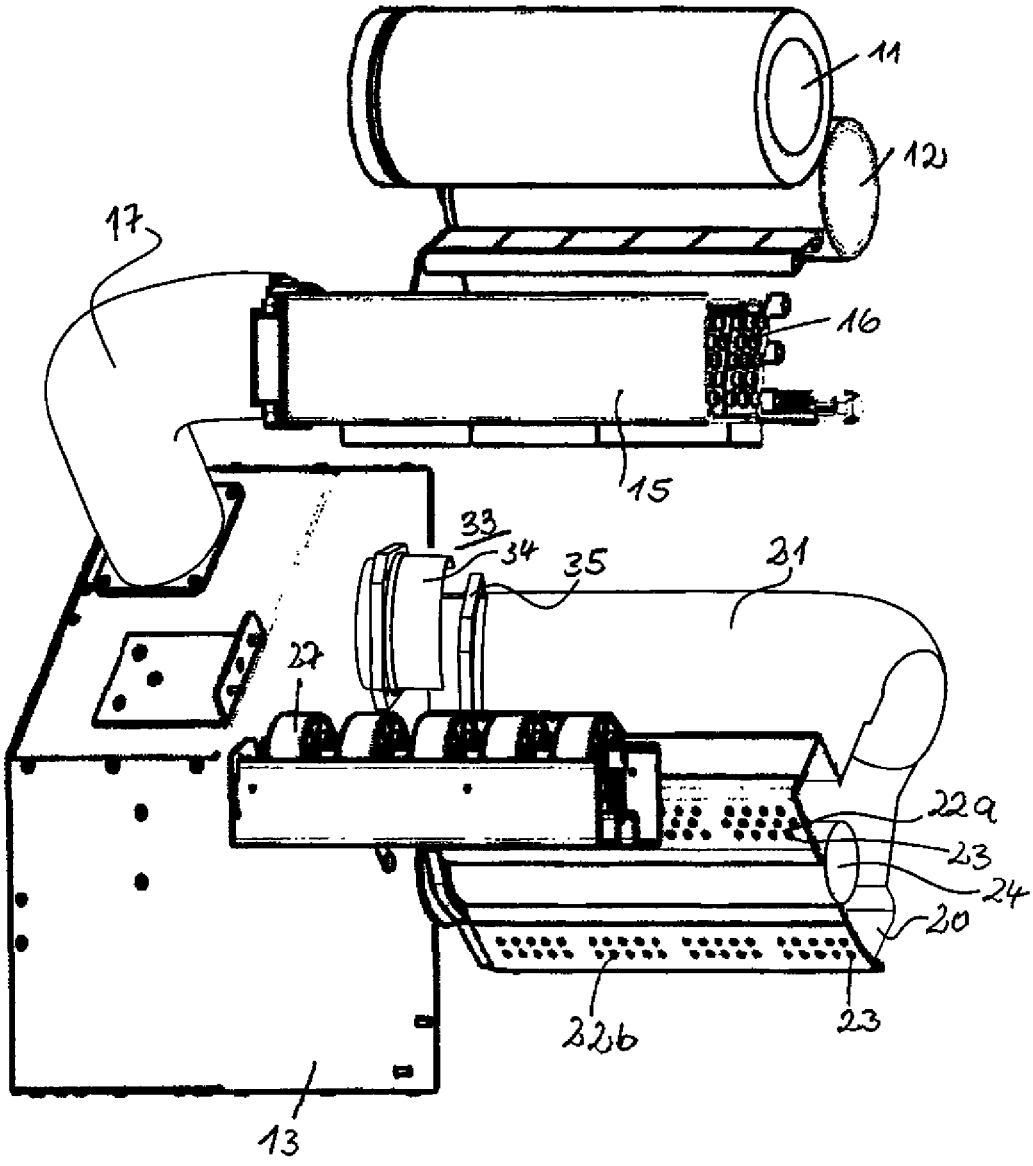
FIG. 3 is a cooling device in which one part is folded down.
Figure 4:
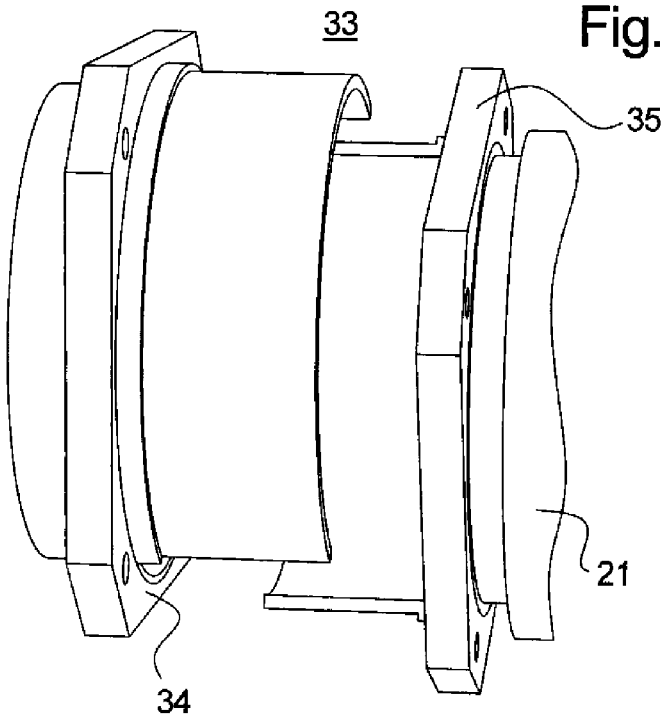
FIG. 4 is a coupling.

FIG. 3 shows the cooling device KE given a second cooling channel 20 pivoted away. In order to arrive in this position, the second cooling channel 20 is pivoted away from the contact pressure roller 25. In this pivoting process, the connection of the second cooling tube 21 with the cooled air source 13 is released. For this a coupling 33 is provided that has two coupling pieces 34, 35 in the shape of half shells, wherein one coupling piece 34 is associated with the cooled air source 13 and the other coupling piece is associated with the second cooling tube 21. Via rotation, the coupling pieces 34, 35 can be detached from one another or can be connected with one another. A realization of the coupling 33 can be learned from FIG. 4; there both coupling pieces 34, 35 are shown, wherein the one coupling piece 34 is connected with the cooled air source 13 and the coupling piece 35 is connected with the second cooling tube 21. Each coupling piece 34, 35 has a half shell, wherein the two half shells are matched to one another so that the two half shells detach from one another or engage in one another via rotation.

Furthermore, the connection of the first cooling channel 15 with the cooled air source 13 via the first cooling tube 17 can be learned from FIG. 3. The first cooling channel 15 is arranged above the cooled air source 13 and is connected with the cooled air source 13 via the first cooling tube 17. From FIG. 3 it arises that long, glossy cooling tubes 17, 21 are avoided via the optimal arrangement of the cooling channels 15, 20 relative to the cooled air source 13.

Figure 5:
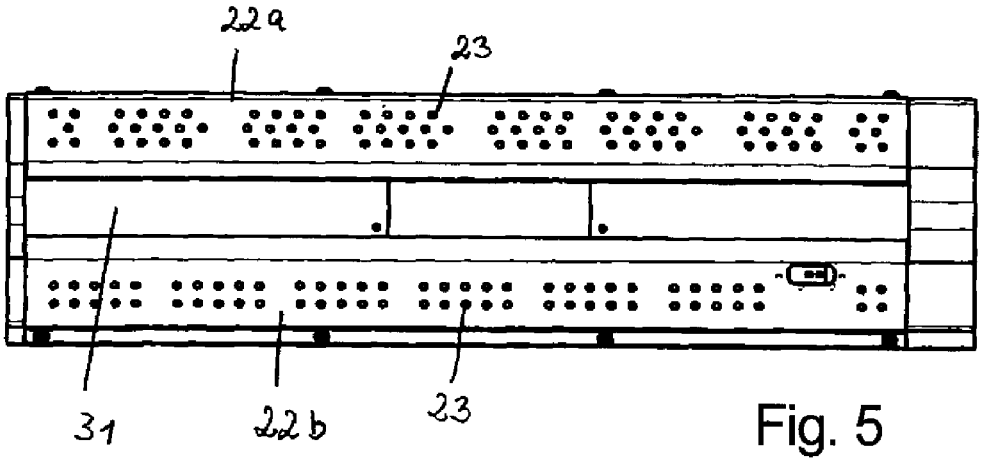
FIG. 5 is a front view of a perforated plate used in the cooling device.

For the preferred embodiment of the invention the perforated plate 22 can be learned from FIG. 5. In the upper perforated plate section 22*a*, the cooling holes 23 lie offset from one another within groups; in the lower perforated plate section 22*b*, the cooling holes 23 lie atop one another in groups. The groups of cooling holes in the upper and lower perforated plate sections 22*a*, 22*b* are additionally arranged offset relative to one another. Via selection of the position of the cooling holes 23, it can be achieved that the printing substrate 10 is cooled as desired; for example, the creation of heat bands on the printing substrate 10 can be prevented.

While preferred embodiments have been illustrated and described in detail in the drawings and foregoing description, the same are to be considered as illustrative and not restrictive in character, it being understood that only two preferred embodiments have been shown and described and that all changes and modifications that come within the spirit of the invention both now or in the future are desired to be protected.

We claim as our invention:

1. A cooling device for a printing substrate after its passage through a fixing station of an electrographic printer or copier, said fixing station thermofixing toner images applied on the printing substrate, comprising:

a transport path for the printing substrate;

a first cooling unit connected with a first coolant source provided along one side of the transport path for the printing substrate, said first cooling unit having a first perforated plate on a surface facing towards the printing substrate, a coolant being conducted through said first perforated plate onto one side of the printing substrate;

a second cooling unit connected with a second coolant source provided along an opposite side of the transport path for the printing substrate, said second cooling unit having a second perforated plate on a surface facing towards said opposite side of the printing substrate, a coolant being conducted through said second perforated plate onto the opposite side of the printing substrate;

a nip unit for the printing substrate that has a nip roll integrated into the second cooling unit such that said nip roll is cooled by the second cooling unit; and the nip unit comprising the nip roll and a contact pressure roller that presses the printing substrate onto the nip roll so that the nip roll draws the printing substrate past the first perforated plate of the first cooling unit and past the second perforated plate of the second cooling unit.

2. A cooling device according to claim 1, in which at least one of the first and second perforated plates is designed as a nozzle plate that has nozzles as cooling holes.

3. A cooling device according to claim 2 wherein the first and second perforated plates have cooling holes which are arranged offset relative to one another.

4. A cooling device according to claim 1 in which the first coolant source and the second coolant source are combined into a common coolant source.

5. A cooling device according to claims 4 in which the first cooling unit comprises a first cooling channel connected with the common coolant source via a first cooling tube, the printing substrate being directed past said first cooling channel, and said first perforated plate surface facing towards the printing substrate being designed with cooling holes.

6. A cooling device according to claim 5 wherein the cooling holes within the first perforated plate are arranged offset relative to one another.

7. A cooling device for a printing substrate after its passage through a fixing station of an electrographic printer or copier, said fixing station thermofixing toner images applied on the printing substrate, comprising:

a transport path for the printing substrate;

a first cooling unit connected with a first coolant source provided along one side of the transport path for the printing substrate, said first cooling unit having a first perforated plate on a surface facing towards the printing substrate, a coolant being conducted through said first perforated plate onto one side of the printing substrate;

a second cooling unit connected with a second coolant source provided along an opposite side of the transport path for the printing substrate, said second cooling unit having a second perforated plate on a surface facing towards said opposite side of the printing substrate, a coolant being conducted through said second perforated plate onto the opposite side of the printing substrate;

a nip unit for the printing substrate that has a nip roll integrated into the second cooling unit such that said nip roll is cooled by the second cooling unit;

the first cooling source and the second cooling source being combined into a common coolant source; and the second cooling unit together with the nip roll being designed such that it can pivot away from the first cooling unit and the common coolant source.

8. A cooling device for a printing substrate after its passage through a fixing station of an electrographic printer or copier, said fixing station thermofixing toner images applied on the printing substrate, comprising:

a transport path for the printing substrate;

a first cooling unit connected with a first coolant source provided along one side of the transport path for the printing substrate, said first cooling unit having a first perforated plate on a surface facing towards the printing substrate, a coolant being conducted through said first perforated plate onto one side of the printing substrate;

a second cooling unit connected with a second coolant source provided along an opposite side of the transport path for the printing substrate, said second cooling unit having a second perforated plate on a surface facing towards said opposite side of the printing substrate, a coolant being conducted through said second perforated plate onto the opposite side of the printing substrate;

a nip unit for the printing substrate that has a nip roll integrated into the second cooling unit such that said nip roll is cooled by the second cooling unit;

the first cooling source and the second cooling source being combined into a common coolant source; and the second cooling unit being arranged adjacent to the common coolant source, and the second cooling unit comprising a second cooling channel connected with the common coolant source via a second cooling tube, the printing substrate being directed past said second cooling channel, and the surface facing towards the printing substrate being designed as said second perforated plate having cooling holes, and wherein the second perforated plate being sub-divided by the nip roll into two perforated plate sections, such that said nip roll is surrounded by the second cooling channel on all sides except a contact surface facing towards the printing substrate.

9. A cooling device according to claim 8 wherein the perforated plate sections have cooling holes arranged offset relative to one another.

10. A cooling device according to claim 8 wherein the second cooling tube is connected to the coolant source via a coupling, such that a connection of the second cooling tube with the coolant source is released upon pivoting the second cooling channel away from said coolant source and is reestablished upon pivoting towards it.

11. A cooling device according to claim 8 wherein the second cooling channel connected with the coolant source via the second cooling tube is provided on the opposite side of the printing substrate, the second cooling channel having on the surface facing towards the printing substrate the second perforated plate sub-divided into said perforated plate sections and through the cooling holes of the second cooling plate coolant being directed towards the opposite side of the printing substrate such that a coolant cushion forms under the printing substrate; and the nip roll of the nip unit for the printing substrate being integrated into the second perforated plate of the second cooling channel between the perforated plate sections such that the nip roll is cooled via the second cooling channel.

12. A cooling device for a printing substrate after its passage through a fixing station of an electrographic printer or copier, said fixing station thermofixing toner images applied on the printing substrate, comprising:

a transport path for the printing substrate;

a first cooling unit connected with a first coolant source provided along one side of the transport path for the printing substrate, said first cooling unit having a first perforated plate on a surface facing towards the printing substrate, a coolant being conducted through said first perforated plate onto one side of the printing substrate;

a second cooling unit connected with a second coolant source provided along an opposite side of the transport path for the printing substrate, said second cooling unit having a second perforated plate on a surface facing towards said opposite side of the printing substrate, a coolant being conducted through said second perforated plate onto the opposite side of the printing substrate;

a nip unit for the printing substrate that has a nip roll integrated into the second cooling unit such that said nip roll is cooled by the second cooling unit;

the first coolant source and the second coolant source being combined into a common coolant source;

the first cooling unit comprising a first cooling channel connected with the common coolant source via a first cooling tube, the printing substrate being directed past said first cooling channel, and said first perforated plate surface facing towards the printing substrate being designed with cooling holes;

the first cooling channel being connected with the first coolant source via the first cooling tube being provided on the one side of the printing substrate, said first cooling channel having on the surface facing towards the printing substrate a nozzle plate as said first perforated plate with nozzles through which coolant is directed onto the one side of the printing substrate; and a roller saddle arranged on the side of the printing substrate facing away from the first perforated plate and the printing substrate being directed past the first perforated plate by the nip roll.

13. A cooling device according to claim 12 wherein the nozzles of the first perforated plate are shaped such that the cooled air is accelerated towards the printing substrate.

14. A method for cooling a printing substrate after its passage through a fixing station of an electrographic printer or copier, said fixing station thermofixing toner images applied on the printing substrate, and wherein a printing substrate is transported through a transport path of a cooling device, comprising the steps of:

providing a first cooling unit of the cooling device connected with a first coolant along one side of the transport path for the printing substrate, said first cooling unit having a first perforated plate on a surface facing towards one side of the printing substrate;

conducting a coolant through said first perforated plate onto said one side of the printing substrate;

directing a coolant onto an opposite side of the printing substrate via a second cooling unit connected with a second coolant source arranged at said opposite side of the transport path for the printing substrate, said second cooling unit having a second perforated plate on a surface facing towards the opposite side of printing substrate;

integrating a nip roll of a nip unit for the printing substrate into the second cooling unit such that said nip roll is cooled by the second cooling unit; and providing the nip unit with a contact pressure roller that presses the substrate onto the nip roll, and drawing the printing substrate with the nip roll past the first perforated plate of the first cooling unit and past the second perforated plate of the second cooling unit.

15. A cooling device for a printing substrate after its passage through a fixing station of an electrographic printer or copier, said fixing station fixing toner images applied on the printing substrate, comprising:

a transport path for the printing substrate;

a first cooling unit connected with a first coolant source provided along one side of the transport path for the printing substrate, said first cooling unit having a first perforated plate on a surface facing towards the printing substrate, a coolant being conducted through said first perforated plate onto one side of the printing substrate;

a second cooling unit connected with a second coolant source provided along an opposite side of the transport path for the printing substrate, said second cooling unit having a second perforated plate on a surface facing towards said opposite side of the printing substrate, a coolant being conducted through said second perforated plate onto the opposite side of the printing substrate;

a drive unit for the printing substrate positioned at the second cooling unit such that said drive unit is cooled by the second cooling unit;

the drive unit having a contact pressure roller that presses the printing substrate onto a nip roll so that the nip roll draws the printing substrate past the first perforated plate of the first cooling unit and past the second perforated plate of the second cooling unit; and the second cooling unit together with the nip roll being pivotable away from the first cooling unit.

16. A method for cooling a printing substrate after its passage through a fixing station of an electrographic printer or copier, said fixing station fixing toner images applied on the printing substrate, and wherein a printing substrate is transported through a transport path of a cooling device, comprising the steps of:

providing a first cooling unit of the cooling device connected with a first coolant along one side of the transport path for the printing substrate, said first cooling unit having a first perforated plate on a surface facing towards one side of the printing substrate;

conducting a coolant through said first perforated plate onto said one side of the printing substrate;

directing a coolant onto an opposite side of the printing substrate via a second cooling unit connected with a second coolant source arranged at said opposite side of the transport path for the printing substrate, said second cooling unit having a second perforated plate on a surface facing towards the opposite side of printing substrate;

integrating a drive unit for the printing substrate positioned at the second cooling unit such that said drive unit is cooled by the second cooling unit;

providing the drive unit with a contact pressure roller that presses the printing substrate onto a nip roll so that the nip roll draws the printing substrate past the first perforated plate of the first cooling unit and past the second perforated plate of the second cooling unit; and providing the second cooling unit together with the nip roll such that it can pivot away from the first cooling unit.

* * * * *